United States Patent [19]

Simon et al.

[11] 4,254,635

[45] Mar. 10, 1981

[54] INSTALLATION FOR THE STORAGE OF CONTINUOUSLY GENERATED COLDNESS AND FOR THE INTERMITTENT EMISSION OF AT LEAST A PORTION OF THE STORED COLD

[75] Inventors: Laszlo Simon, 61 Ave. du Bois-de-la-Chapelle, Onex CH 1213, Switzerland; Jean-Marc Frantz, Schönbuch, Switzerland

[73] Assignee: Laszlo Simon, Onex, Switzerland

[21] Appl. No.: 974,095

[22] Filed: Dec. 28, 1978

[30] Foreign Application Priority Data

Jan. 6, 1978 [CH] Switzerland ..... 157/78

[51] Int. Cl.[3] ..... I25D 3/00

[52] U.S. Cl. ..... 62/317; 62/59; 62/123

[58] Field of Search ..... 62/59, 317, 437, 123

[56] References Cited

U.S. PATENT DOCUMENTS

| | | | |
|---|---|---|---|
| 2,160,389 | 5/1939 | Palmer | 62/59 |
| 2,246,401 | 6/1941 | Waterfill et al. | 62/59 |
| 2,572,508 | 10/1951 | Moffly | 62/59 X |
| 2,996,894 | 8/1961 | Shade | 62/59 |
| 3,338,064 | 8/1967 | Karnofsky | 62/123 X |
| 3,766,752 | 10/1973 | Laing | 62/59 X |
| 4,044,568 | 8/1977 | Hagen | 62/59 X |

*Primary Examiner*—Albert J. Makay
*Assistant Examiner*—William E. Tapolcai, Jr.
*Attorney, Agent, or Firm*—Kurt Kelman

[57] ABSTRACT

Installation for storing continuously generated cold and for the intermittent release of at least a portion of the stored cold, with a storage container for a mixture of cold water and ice, by a cooling device for delivering ice continuously to the storage container, and with means for removing cold water intermittently from the storage container and for cycling it to an apparatus to be cooled and then for recycling it back to the storage container.

4 Claims, 5 Drawing Figures

Figure 1:
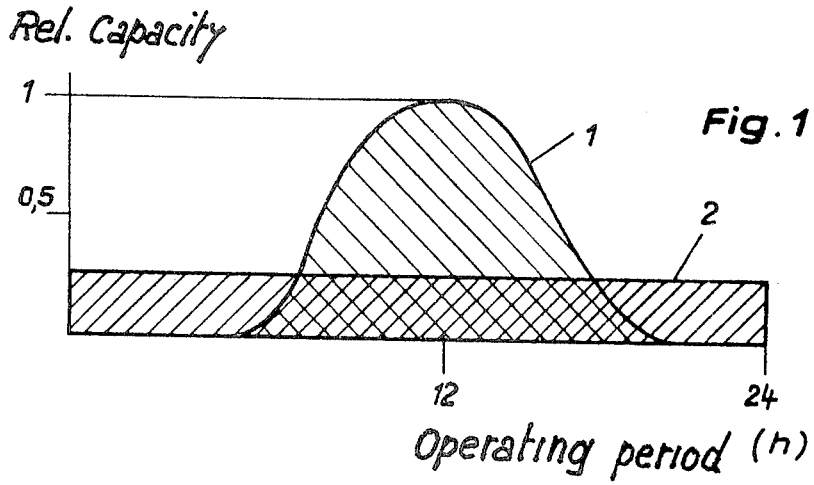

INSTALLATION FOR THE STORAGE OF CONTINUOUSLY GENERATED COLDNESS AND FOR THE INTERMITTENT EMISSION OF AT LEAST A PORTION OF THE STORED COLD

The present invention relates to an installation for storing continuously generated cold and for the intermittent release of at least a portion of the stored cold.

Methods are already known which aim at cold storage for the purpose of multiplying production. For instance, cold water or brine is stored in containers. Due to the relatively small temperature differences which can thereby be attained, relatively large volumes are required for accumulating a certain amount of cold, which is connected with high installation costs. Furthermore, due to mixing, the temperature is difficult to control during the charging and discharging of such storage containers.

In another method, plate- or tube-shaped evaporation elements immersed in a water container are used on whose surfaces an ice layer is formed. In the interior of these elements, a refrigerating medium is evaporated at a temperature below 0° C., which produces a steadily growing ice layer on the outside.

The resistance to heat transfer between the evaporating refrigerant and the water is necessarily increased with the increasing thickness of the ice layer, which causes the refrigeration efficiency to decrease steadily. To hold the decrease in the cold efficiency within acceptable limits, correspondingly larger exchange surfaces must be installed. This increases the manufacturing costs.

Since the melting and the growth of the ice around the elements proceeds necessarily irregularly, there is the danger that water occlusions completely surrounded by ice may be formed in certain spatially limited parts of such containers. There is the danger of damage to the apparatus due to cracks and displacements of the ice mass strongly adhering thereto because of the spatial expansion during freezing of the occluded water. In addition, the release of cold is also made more difficult because of the undercooling of the formed ice layer since melting, for example of ice water, occurs only at a temperature of the ice surface of 0° C. Agitating devices or additional circulating pumps are required to enhance the heat transfer. However, a relatively high temperature differential between the melting point of the crystals and the temperature of the liquid remains, which in most instances is disadvantageous.

In summary, it may be said that, in the present state of the art, cold consumption which varies from time to time is covered by a correspondingly variable cold production, the installed capacity of the cold installation having to meet the maximal cold consumption and, therefore, causing high installation costs. To meet peak cold demands with reduced refrigerating capacity, storage containers have also been used but they do not permit optimal utilization of all possibilities for reducing costs. When storing only by lowering the temperature of the refrigerant, that is without changing its state, the volume requirements are too large; such installations, therefore, become unwieldy.

In the conventional storage containers with ice accumulation on fixed separating faces, the ice layer itself interferes with the storage as the mass increases and requires a compensating enlargement of the heat exchange faces.

The installation according to the invention, as defined in the claims, entails a decisive advance.

In industrial, commercial and air conditioning installations whose cold need varies considerably in the course of a given period of operation, it is not required according to the invention to conform the capacity of the refrigeration installation accurately to the maximal cold requirements. Therefore, it is sufficient to provide a refrigeration installation whose capacity limit needs to correspond only to the average value of the cold consumption in the course of the operating period under consideration.

With the construction of the refrigerating installation according to the invention, the indicated disadvantages may be eliminated. The ice serving for the storage of the later cold is produced directly in the interior of the storage container in the form of tubular or plate ice. When a certain thickness of the ice layer has been reached, the refrigerating process is interrupted and the formed ice is detached from the surface of the evaporator by introducing therein hot refrigerant vapor. Subsequently, the refrigerating process starts anew. Because the thickness of the ice formations is held low, the coefficient of heat transmission is not reduced too much and the refrigeration efficiency remains high. Since the ice formation is detached from the surface of the evaporator, the ice pieces produce twice the surface during melting, which favors the release of cold. Since the specific weight of the ice is smaller than that of the refrigerant liquid, the ice swims on it. Due to the fact that water reaches its highest density at +4° C., a thermal up-draft along the pieces of ice will occur first at the introduction of the warmer refrigerant, which causes a more intensive melting. Even if the evaporator surface is still partially undercooled as the pieces of ice are removed therefrom, they will not grow together because the cold of the undercooling will be drawn off by freezing the water to the surface at 0° C. Thus, every piece of ice very rapidly reaches an average temperature of 0° C. in the container and offers the most favorable conditions for melting.

A refrigerating installation according to the invention, therefore, requires no control device for the refrigerating capacity. This advantage over conventional refrigerating installations can be gleaned from FIG. 1 in noting the efficiency curves in the drawing.

Since freezing of the water produces roughly a 9% increase in volume, the storage container itself may serve as expansion vessel by filling the upper part of the space with air or nitrogen. Thus, a separate expansion vessel may be omitted. The method may also be used with other refrigerants, such as, for example, all conventional brines down to the temperature at the eutectic point.

Another modification with respect to the ice production according to the invention is the use of an evaporator-crystallizer. In this, the refrigerant liquid is mixed with a cooling agent which is not dissolved therein. During evaporation, it withdraws from the water the evaporation heat, thus forming ice crystals.

The storage container itself may serve also as evaporator-crystallizer at a suitable pressure, which again aids in reducing the cost of the apparatus. The cooling agent used for this should have the following properties:

(a) Pressure at the required evaporation temperature should be above atmospheric pressure.

(b) Lack of solubility in and miscibility with water.

(c) Chemical stability, no toxicity, no tendency to corrode materials used specifically in this field.

The invention will now be explained in conjunction with certain embodiments and the drawing wherein FIG. 1 shows the refrigerating capacity and cold consumption as a function of time;

FIGS. 2–5 each shows an embodiment of the invention.

Curve 1 shown in FIG. 1 indicates the cold consumption of an apparatus to be cooled as a function of the time of day. In a conventional refrigerating installation, the refrigerating capacity necessarily follows the same curve. The installed capacity corresponds to the maximal cold consumption but the machine is utilized poorly.

Line 2 indicates an intermittent refrigerating installation according to the invention, with accumulation for cold consumption according to 1. The area below the two curves 1 and 2 is identical; it corresponds to the refrigeration per day. In this example, 24 hours are used as the basis for the operating period. The refrigerating capacity of the installation according to curve 2 is uniformly distributed over the entire operating period. The machine is small and optimally charged compared to one which refrigerates and discharges cold according to curve 1. The electrical capacity is reduced, the day current peak is eliminated. A considerable portion of the cold is produced during the night hours when current prices are reduced. The capacity range of existing smaller refrigerators is multiplied.

Figure 2:
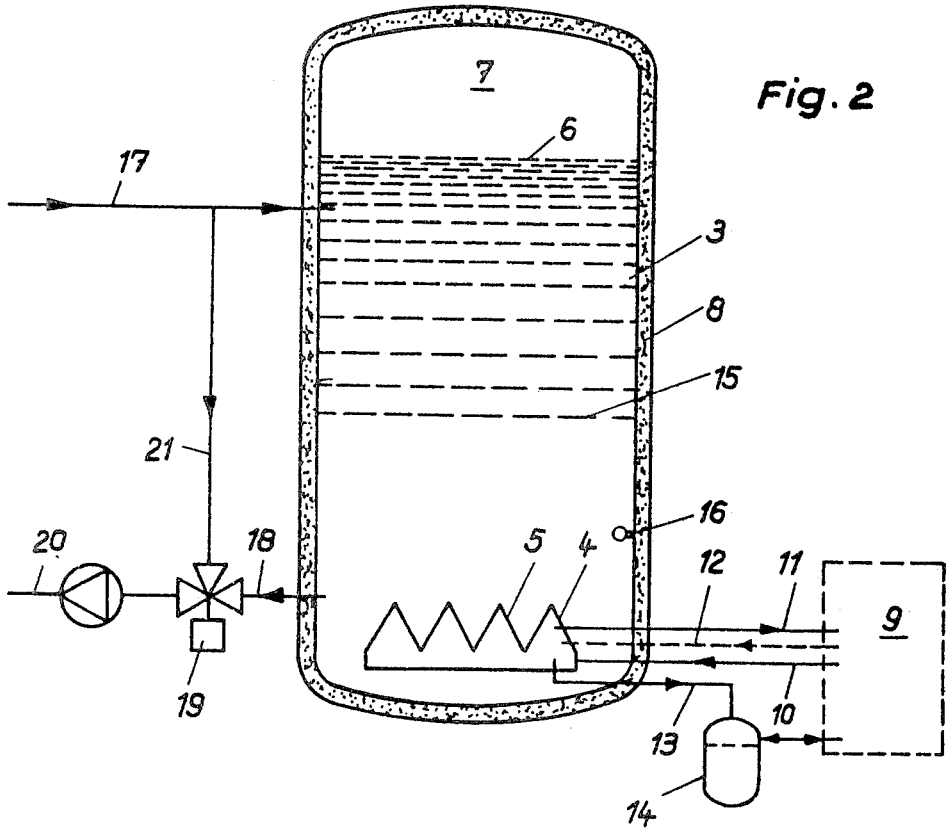

FIG. 2 shows evaporator 4 operating as a tube or plate cooler and installed at the bottom of a storage container 3. An ice layer 5 is formed on the surface of evaporator 4. The storage container is filled with water up to level 6. Space 7 contains a gas, for example nitrogen or air, and serves as expansion space. The storage container is provided with an insulating jacket 8 against penetration of heat from the outside. Liquid cooling medium is injected into evaporator 4 through a pipe conduit 10 from cooling plant 9 during freezing. The cooling medium vapor is evacuated through pipe conduit 11.

At thawing, hot cooling medium vapor is introduced into evaporator 4 through conduit 12, conduits 10 and 11 are blocked and the liquid cooling medium in evaporator 4 is removed through conduit 13 into the liquid container. The hot cooling medium vapors, which are now condensed on the inner wall of evaporator 4, cause the ice on the contact surface to be thawed and to become detached. The freed ice pieces 5 now float upwardly. The ice pieces collect in the upper part. The evaporation-thawing process is periodically repeated. The ice front 15 travels downwardly until it reaches the level indicated by level sensing instrument 16. At this point, the storage container is fully charged and the refrigerator 9 may be stopped.

Cooling water is removed from storage container 3 through conduit 18 for cooling any desired apparatus, the amount thereof being regulated by a thermostatically-controlled valve 19 and is delivered to the apparatus to be cooled through conduit 20 whence is removed through conduit 17 and is returned to container 3 at the top. Valve 19 regulates the ratio of the amount between by-pass 21 and conduit 18. The temperature of the water recycled through conduit 17 to container 3 tends to equal the storage temperature since a corresponding amount of ice is molten by contact with the warm water.

The temperature of the water is practically 0° C. as it leaves the storage container. This means that the installation can be operated without by-pass 21 with a lead temperature of 0° C. This fact offers the advantage of a reduced circulating amount, particularly in remote refrigerators. Therefore, the required pumps and pipe conduits may be dimensioned smaller to cover the same extent of refrigerating consumption.

Figure 3:
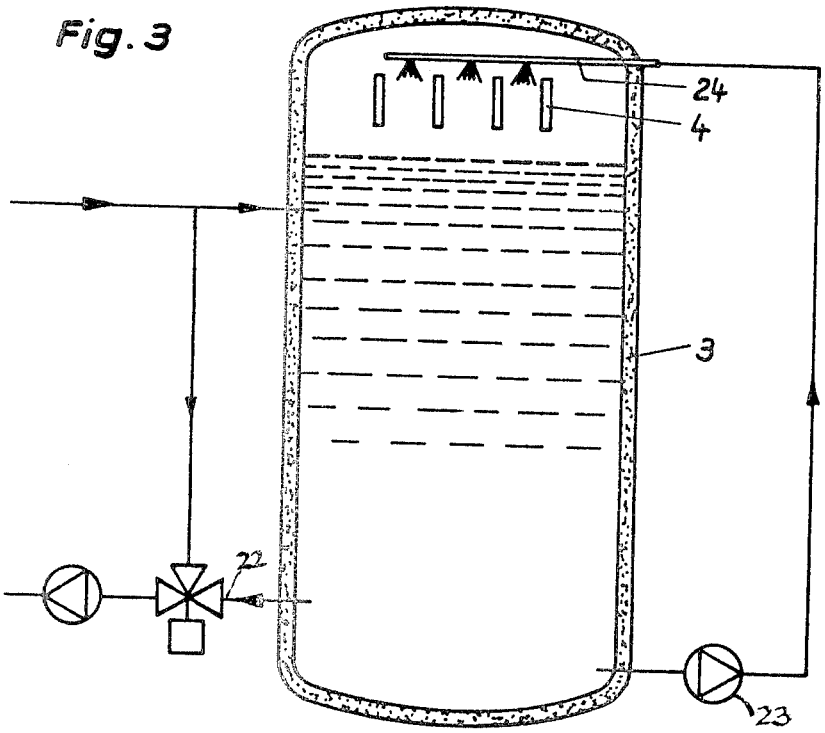

In FIG. 3, evaporator 4 constituted by a tube or plate cooler is arranged above the water level. The process proceeds here as in FIG. 2, except that the water required for the ice formation is removed from the container at the bottom through a pipe conduit 22 and is delivered by a pump 23 and a distributor 24 to the surface of the evaporator. Upon thawing, the pieces of ice fall in the portion of the container filled with water. The evaporator 4 is operated in the same manner as in FIG. 2.

The removal of the cold proceeds in exactly the same manner as has been described hereinabove in connection with FIG. 2.

Crushed ice may be produced with the arrangement of the evaporator above as well as below the water level. For this purpose, the ice is scraped off the surface of the evaporator and is blown off by mechanical shaping. This causes no thermodynamic losses as is the case in the embodiments of FIGS. 2 and 3 because of thawing by means of hot cooling medium vapors.

Figure 4:
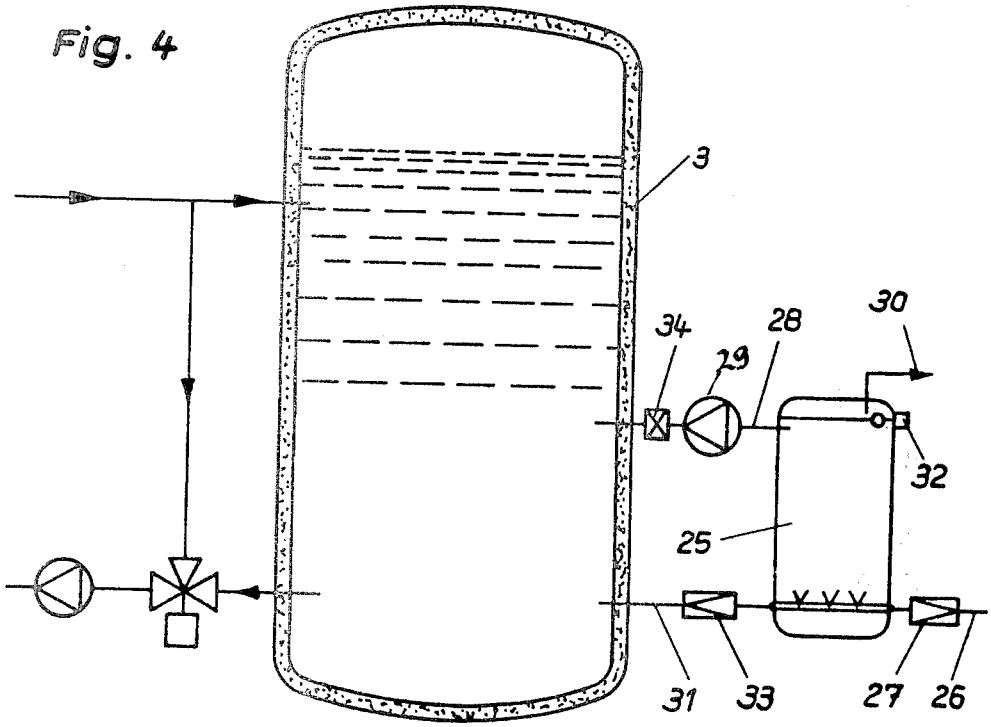

FIG. 4 shows an embodiment of the invention with an evaporator-crystallizer.

Such crystallizers are known and use a cooling medium which is insoluble in water. The liquid cooling medium is introduced into crystallizer 25 at the bottom through conduit 26 and throttle valve 27. Ice crystals are formed during evaporation and float upwardly. They are transported from there into storage container 3 through pipe conduit 28 by pump 29. The cooling medium vapor is evacuated through conduit 30 by a non-illustrated refrigerator, is condensed and, after liquefication, is returned to the crystallizer. Connecting conduit 31 between storage container 3 and evaporator-crystallizer 25 is provided with throttle valve 33 controlled by level governor 32 to be able to maintain the pressure differential between the two. Check valve 34 also arranged in conduit 28 serves this purpose.

Exactly as in FIGS. 2 and 3, the left side of FIG. 4 again shows the apparatus for removing cooling water.

Since the cooling medium in the evaporator-crystallizer is in direct contact with the storage medium (water or eutectic), any oily residues may be transmitted from the compressor.

To remove any oil residues introduced into the evaporator-crystallizer with the cooling medium vapor, a filter may be provided for removal of the oil residues.

Figure 5:
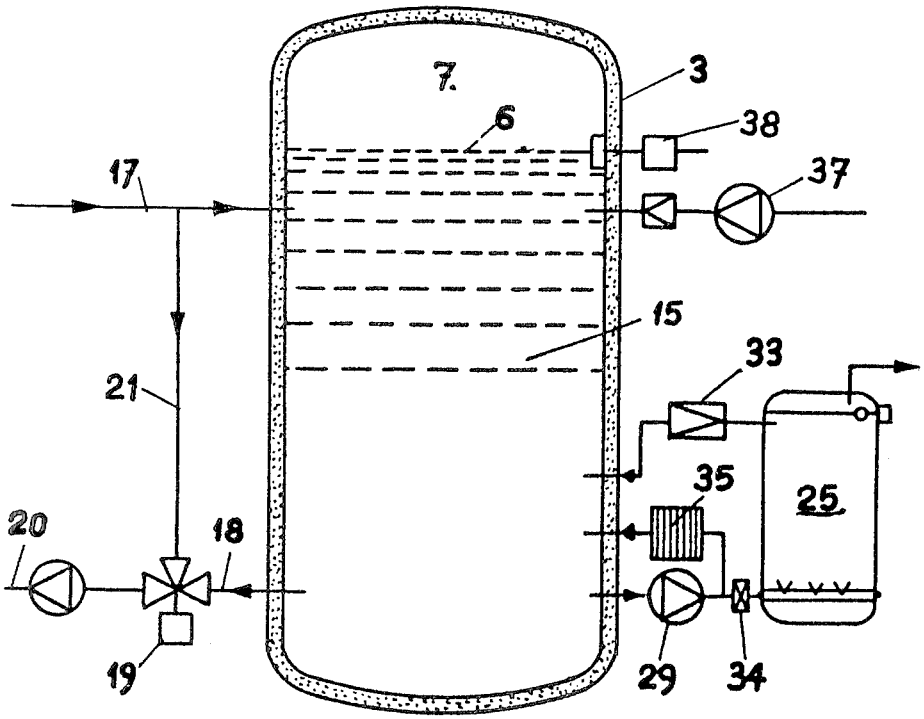

FIG. 5 shows an embodiment corresponding to that of FIG. 4, provided with such a filter. In FIGS. 4 and 5, the same numerals designate the same or analogous parts.

A pump 29, two valves 33 and 34 (analogous to FIG. 4) and filter 35 are provided between storage container 3 and evaporator-crystallizer 25.

The location of pump 29 is determined by the pressure differential between storage container 3 and evaporator-crystallizer 25. For example, the system pressure in FIG. 4 is greater than the evaporation pressure in the crystallizer but the reverse is true in FIG. 5, requiring pump 29 to provide the required increase in pressure.

Oil filters operating on the sorption principle or those based on reverse osmosis may be used as filter 35.

it is not advantageous to comprise the entire stream of water in circulation. This would require unnecessarily large filters and, furthermore, cause a considerable resistance in the main part of the circulation, thus requiring an increased pump capacity.

To eliminate the need for the installation of a secondary pump, the existing pressure differential between the evaporator-crystallizer 25 and storage container 3 is utilized for the removal of oil. For this purpose, the delivery rate of pump 29 is so selected that a certain partial amount is recycled to storage container 3 through filter 35. If filter 35 operates on the sorption principle, its size is adapted to the required dwell time, and the treated partial amount should preferably not exceed about 10% of the amount cycled via conduit 20.

When oil is removed according to the reverse osmosis principle, an outlet for the discharge of the concentrated oil and a filling device 37 for the introduction of replacement water is provided. If the pressure differential of pump 29 between evaporator-crystallizer 25 and storage container 3 is not sufficient to overcome the resistance of the filter, a special pump for filtering is installed, which has not been shown in FIG. 5, however.

To obtain a maximal specific storage capacity (i.e. stored amount of cold energy per unit of volume), the ice paste should be as thick as possible, i.e. there should be little water between the ice crystals.

For this purpose, the natural upward floating force should be utilized and the friction forces between the crystals in contact with each other should be reduced so that they press upwardly while very closely adjacent in storage container 3 and the residual interstices filled with water are as small as possible.

An ultrasonic generator 38, which generates an ultrasonic field directed from above against the ice paste mass, is provided to obtain this result. Most of the time, it is sufficient to operate this ultrasonic generator 38 only intermittently.

What is claimed is:

1. An installation for storing continuously generated cold and for the intermittent release of at least a portion of the stored cold, comprising (a) a storage container for a mixture of cold water and ice, (b) an evaporator-crystallizer containing cold water and a liquid cooling medium insoluble in the water, the cooling medium in contact with the water forming floating ice crystals during evaporation, (c) conduit means for continuously delivering the ice crystals from the evaporator-crystallizer to the storage container to constitute the ice therein, (d) circulating means for removing cold water from the storage container intermittently, cycling the cold water to an apparatus to be cooled, and then recycling the water from the apparatus back to the storage container, and (e) a device for thickening the ice-water mixture in the storage container.

2. Installation according to claim 1 wherein the thickening device is an ultrasonic generator.

3. Installation according to claim 1 characterized in that the cold water consists of a salt brine.

4. Installation according to claim 1 or 3, characterized by an oil filter, in the conduit means between the evaporator-crystallizer and the storage container.

* * * * *